US009787035B1

(12) United States Patent
Wimmer et al.

(10) Patent No.: US 9,787,035 B1
(45) Date of Patent: Oct. 10, 2017

(54) ELECTRICAL PLUG CONNECTOR FOR VEHICLE

(71) Applicant: Lisa Draexlmaier GmbH, Vilsbiburg (DE)

(72) Inventors: Stefan Wimmer, Hohenthann (DE); Robert Saller, Egglkofen (DE); Christian Wimmer, Schalkham (DE); Stefan Rieder, Nandlstadt (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/466,707

(22) Filed: Mar. 22, 2017

(30) Foreign Application Priority Data

Mar. 23, 2016 (DE) ..... 10 2016 105 497

(51) Int. Cl.

| | |
|---|---|
| ***H01R 13/6596*** | (2011.01) |
| ***H01R 13/53*** | (2006.01) |
| ***H01R 13/658*** | (2011.01) |
| ***H01R 13/52*** | (2006.01) |
| ***H01R 24/66*** | (2011.01) |

(52) U.S. Cl.
CPC ..... *H01R 13/6596* (2013.01); *H01R 13/5205* (2013.01); *H01R 13/5213* (2013.01); *H01R 13/5219* (2013.01); *H01R 13/53* (2013.01); *H01R 13/658* (2013.01); *H01R 24/66* (2013.01)

(58) Field of Classification Search
CPC ..... H01R 13/5213; H01R 13/6596
See application file for complete search history.

(56) References Cited

U.S. PATENT DOCUMENTS

| | | | | |
|---|---|---|---|---|
| 5,890,922 | A | 4/1999 | Buchter et al. | |
| 7,988,475 | B2 * | 8/2011 | Sakakura | H01R 9/032 439/271 |
| 8,827,569 | B2 * | 9/2014 | Yamada | H01R 13/621 385/56 |
| 2010/0261363 | A1 | 10/2010 | Sakakura | |

(Continued)

FOREIGN PATENT DOCUMENTS

| | | | |
|---|---|---|---|
| DE | 10 2014 019 620 | A1 | 7/2015 |
| DE | 10 2015 104 377 | A1 | 9/2016 |
| DE | 10 2015 114 080 | A1 | 3/2017 |

OTHER PUBLICATIONS

Office Action in German Application No. DE 10 2016 105 497.6, dated Nov. 11, 2016.

(Continued)

*Primary Examiner* — James Harvey
(74) *Attorney, Agent, or Firm* — Finnegan, Henderson, Farabow, Garrett & Dunner LLP

(57) ABSTRACT

The present disclosure relates to an electrical plug connector, such as a high-voltage plug connector, for a vehicle. The plug connector comprises a plug with a plug casing, one or more electrical contact parts accommodated in the plug casing, a socket with a socket casing, and a protective housing at least partly encasing the plug casing and the socket casing. The protective housing comprises an attachment flange in a connection area reaching up to a counterpart connectable thereto. An engagement ridge of the protective housing is spaced apart from the attachment flange in the longitudinal direction L of the plug connector and at least positively engages in an engagement channel of the plug casing.

20 Claims, 2 Drawing Sheets

(56) References Cited

U.S. PATENT DOCUMENTS

| | | | | |
|---|---|---|---|---|
| 2015/0194769 | A1 | 7/2015 | Fujiwara | |
| 2016/0072211 | A1* | 3/2016 | Kato | H01R 13/6596 439/660 |
| 2016/0285178 | A1 | 9/2016 | Wimmer | |
| 2017/0062980 | A1 | 3/2017 | Wimmer et al. | |

OTHER PUBLICATIONS

Office Action in German Application No. DE 10 2016 105 497.6, dated Nov. 16, 2016.
Decision to Grant in German Application No. DE 10 2016 105 497.6, dated Apr. 13, 2017.

* cited by examiner

ELECTRICAL PLUG CONNECTOR FOR VEHICLE

CROSS REFERENCE TO RELATED APPLICATIONS

This application is based upon and claims the benefit of prior German Patent Application No. 10 2016 105 497.6, filed on Mar. 23, 2016, the entire contents of which are incorporated herein by reference.

TECHNICAL FIELD

The present disclosure relates to an electrical plug connector, in particular to a high-voltage plug connector for a vehicle. A connector of this type can be used for a plug connection in a high-voltage on-board electrical system of a motor vehicle, for example, a hybrid or electric vehicle. For example, the present disclosure may be applied to the electrical contacting of a plug connector to a drive unit or a motor of the vehicle. The present disclosure also relates to a vehicle having such a plug connector.

BACKGROUND

Plug connections and plug connectors for use in a high-voltage on-board electrical system are known. For example, German patent documents DE 10 2015 104 377.7 and DE 10 2015 114 080.2 describe an electrical plug connector that is suitable for use in a high-voltage on-board electrical system. The electrical connector has a contact part with a sleeve that forms a receiving space for a plug-in contact that is to be inserted in a direction of insertion. A contact spring is attached in the interior of the sleeve and is adapted to be urged by a displaceable locking bolt in the direction of the receiving space for the plug-in contact. The electrical plug connector equipped with his contact part makes it easy to insert and withdraw the plug-in contact.

German patent document DE 10 2014 019 620 A1, US Patent Application 2010/0261363 A1 and U.S. Pat. No. 5,890,922 A disclose electrical plug contacts. However, the plugs suffer from various drawbacks. For example, it is desirable to improve the plug connection with regard to vibration resistance, as this would result in greater suitability for contacting a drive unit or motor of a vehicle.

SUMMARY

Embodiments of the present disclosure to provide an electrical plug connector using simpler construction that exhibits good vibration resistance properties and is suitable for contacting a motor of a vehicle.

Embodiments of the present disclosure provide an electrical plug connector, which may be used as a high-voltage plug connector in a high-voltage on-board electrical system of a vehicle. The electrical plug connector comprises at least one electrical contact part. For example, a contact part of this type is described in German patent application DE 10 2015 104 377 and in German patent application DE 10 2015 114 080, the entire contents of which are incorporated herein by reference. The contact part may have a high current-carrying capacity of up to 180 amperes at 85° C. In this connection, "high voltage" is understood as an electric tension amounting to at least approximately 48 V, but may be 60 V or more, or 400 V up to approximately 650 to 1000 V. An on-board electrical system of this type is found, for example in subsystems in a motor vehicle or for drive and auxiliary power units in a hybrid or electric vehicle.

According to embodiments of the present disclosure, the electrical plug connector comprises a plug casing that accommodates the contact part and a protective housing that at least partly encases the plug casing. In some embodiments, several contact parts may be housed in the plug casing, thereby making plug connectors with several poles, for example with three poles, in addition to one-pole connectors. In this connection a protective housing can be understood to be a case-like shield for the electrical plug connector, to prevent or reduce the emittance or incidence of electric or electromagnetic fields. For this purpose the protective housing, embodied here as a sum shield in the case of a multi-pole plug, is made of a metal material. The metal material may be aluminum or an aluminum alloy for purposes of lightweight construction and ensuring good electrical conductivity.

According to embodiments of the present disclosure, the protective housing of the plug connector may have an attachment flange situated in a connecting area up to a counterpart adapted for connection to the plug connector or to the plug casing and/or the protective housing. The protective housing may have an engagement ridge that is spaced apart from the attachment flange in the longitudinal direction of the plug connector, which is also parallel to the plugging direction of the plug connector. To enable good vibration resistance of the plug connector in the assembled state, i.e. when installed in the vehicle, the engagement ridge latches into an engagement channel of the plug casing at least in a positive fit. The engagement ridge of the protective housing may extend in the longitudinal direction of the plug connector. This may also be the plugging direction. The engagement ridge may be integral with the protective housing and protrudes in the interior of the protective housing in the longitudinal direction (i.e. in the plugging direction) of the plug connector. In other words, the engagement ridge extends toward the counterpart. This way, the plug casing can be pressed against the counterpart, which may be a counter-housing, a socket or other counterpart. This results in higher vibration resistance.

According to embodiments of the present disclosure, when the protective housing is secured over the attachment flange, the plug casing is pressed by the protective housing onto the counterpart that cooperates with the attachment flange. The plug casing is thus clamped between the protective housing and the counterpart that is affixed to it. The longitudinal gap between the attachment flange and the engagement channel or the engagement ridge additionally creates a tilt-proof arrangement.

According to embodiments of the present disclosure, the plug connector results in a good or high degree of vibration resistance together with good electromagnetic compatibility, since the protective housing can be reliably secured via the attachment flange to the counterpart, which may be a counter-housing, a socket, or other counterpart. Moreover, the plug casing is also held by the protective housing in addition to the hold provided by the plugged connection to the counterpart that is connectable to the protective housing. The plug connector of the present disclosure is capable of achieving a vibration resistance rating of severity level 4 in accordance with Specification LV 214, PG 17. Thus, the plug connector of the present disclosure is suitable for use near the motor or for direct contacting of a drive unit or a motor of the vehicle thus equipped.

Embodiments of the present disclosure provide a plug connector comprising a socket and a socket casing. The socket casing may have a support flange on the face end for support on the counterpart. In this case the attachment flange grasps around the support flange in a positive fit. The support flange is supported on the counterpart such that the socket casing and the plug casing plugged to it are clamped between the engagement ridge and the counterpart. Moreover, the inner contour of the attachment flange and the outer contour of the support flange positively engage in such a manner that the plug casing and the socket casing are also fixed in the peripheral direction of the plug connector.

Embodiments of the present disclosure provide easier assembly of the plug connector. For example, the engagement channel may be open against the plugging direction of the plug connector or against the direction in which the engagement ridge extends. In this way the engagement ridge of the protective housing can be inserted into the engagement channel with greater ease.

According to embodiments of the present disclosure, to keep the plug casing and the contact part accommodated therein as free of vibration as possible, the plug and the socket may be formed in a manner permitting them to be pressed against the counterpart by the protective housing adapted to them. For this purpose, a gap between an end of the engagement ridge facing the counterpart, which may be an opposite housing or a socket, and a face of the socket casing, which abuts the counterpart, corresponds to a gap between a bottom of the engagement channel and the face of the socket casing that abuts the counterpart. This allows the plug casing to be pressed against the counterpart by the protective housing or clamped between these two parts. The mechanical degrees of freedom of the plug casing are thus restricted to such an extent that a high resistance to vibration is achieved in the plug connector.

According to embodiments of the present disclosure, the engagement ridge and/or the engagement channel are substantially peripheral to allow a uniform retaining force to be exerted on the plug casing without canting or the like. In this case neither the plug casing nor the protective housing has to be rotationally symmetrical. Instead, both casings may be flattened on one or more sides.

According to embodiments of the present disclosure, an outer wall of the engagement channel may be situated in or engaged with a protective housing groove formed by the engagement ridge and a protective housing wall that interacts with the ridge.

According to embodiments of the present disclosure, a first sealing element is arranged between an inner wall of the engagement channel and the engagement ridge, in order to seal the plug casing from the protective housing for protection against environmental influences. The first sealing element may be a sealing ring inserted into the engagement channel. The sealing element may be made of rubber, silicone or butyl. The first sealing element here can be dimensioned and/or formed in such a manner that, due to its elasticity, it presses the engagement ridge of the protective housing to the outside in a direction transverse to the plug connector, i.e. in a direction perpendicular to the longitudinal direction and/or the plugging direction. As a result, the engagement ridge and the engagement channel possibly engage in a friction fit in addition to the positive fit.

According to embodiments of the present disclosure, to optimize the sealing off from environmental influences between an electric wire connectable to the contact part and the plug casing, a second sealing element is arranged between an inner wall of the engagement channel and the electric wire connectable to the contact part. This second sealing element may be a sealing ring slipped over the wire in the longitudinal direction. The sealing element may be made of rubber, silicone or butyl.

According to embodiments of the present disclosure, the first sealing element and the second sealing element may be spatially separated from one another by the inner wall of the engagement channel to improve the sealing action. In this way, each of the two sealing elements can be supported on the inner wall of the engagement channel such that the inner wall forms a counter-bearing for the sealing element.

According to embodiments of the present disclosure, to improve the sealing action of the protective housing from a counterpart such as a housing part, the attachment flange may have a sealing groove in which a third sealing element is situated. This third sealing element may be a sealing ring, for example. The sealing element may be made of rubber, silicone or butyl.

According to embodiments of the present disclosure, to improve the vibration resistance, an inner contour of the attachment flange and an outer contour in a face area of the plug casing may positively engage one another.

Embodiments of the present disclosure also relate to a vehicle having a plug connector in one or more of the variants of the embodiments described above. This vehicle owes its high functional reliability to the good vibration resistance of the plug connector.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

BRIEF DESCRIPTION OF THE DRAWINGS

The drawings depict merely schematic representations and serve only to illustrate the present disclosure. The same or similar elements are provided throughout with the same reference numbers. In the drawings.

DETAILED DESCRIPTION

Figure 1:
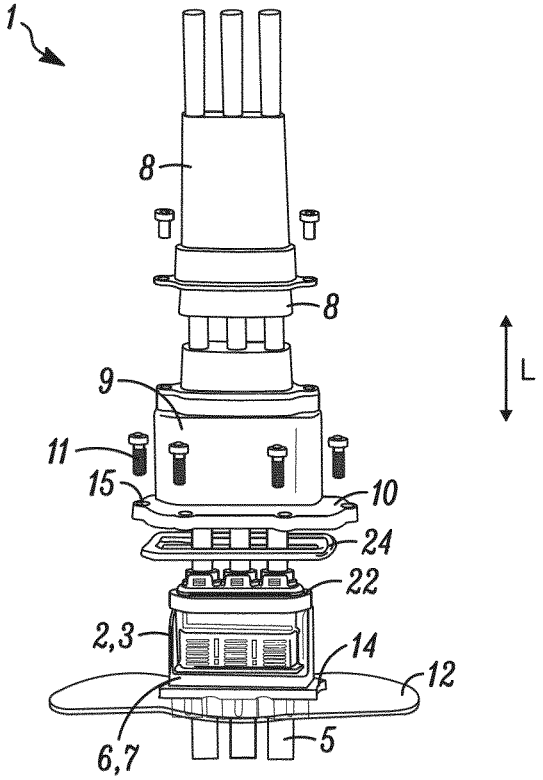
FIG. 1 is an exploded view of a plug connector of the present disclosure fixed to a counterpart.

FIG. 1 is an exploded view of a plug connection with an electrical plug connector 1 for use as a high-voltage plug connector in a high-voltage on-board electrical system of a vehicle (not shown). The plug connector 1, for example, is suitable for electrically contacting a motor of the vehicle.

The plug connector 1 comprises a plug 2 with a plug casing 3 made of plastic that is adapted to accommodate an electrical contact part 4 (hidden, i.e. not shown in FIG. 1; see FIG. 3) for contacting a plug-in contact 5, The plug-in contact 5 here is part of a socket 6, particularly a header, of the plug connector 1, with a socket casing 7 that is made of plastic and holds the plug-in contact 5 in place. In this embodiment the plug connector 1 is shown with three poles as an example, such that three adjacent contact parts 4 are accommodated in the plug casing 3 to contact with three plug-in contacts 5 of the socket 6. The plug 2 and socket 3 are adapted for being releasably plugged together. They may be fixed or locked together via the plug casing 3 and the socket casing 7. FIG. 1 also shows that an electric wire 8 is also coupled to each contact part 3.

The plug casing 3 and the socket casing 7 are at least partly encased in a protective housing 9. The protective housing 9 here is made of aluminum or an aluminum alloy, exhibits good electrical conductivity and is relatively lightweight. The protective casing 9 has an integral attachment flange 10 formed thereupon, with peripheral through holes 15 to accommodate fastening elements 11. FIG. 1 shows that the fastening elements 11 here may be provided in the form of screws.

The protective housing 9 is attached by the integral attachment flange 10 to a counterpart 12 in a connection area using the fastening elements 11. The counterpart in this embodiment is a housing of aluminum or an aluminum alloy of a vehicle motor (not shown). The socket 6 and/or socket casing 7 is held on the counterpart 12 by a clip connection. For this purpose the socket casing 7 has a plurality of fixing elements that engage into the counterpart 12 at least in a positive fit and possibly also a friction fit.

An annular face surface 13 (see FIG. 3) of a support flange 14 of the socket casing 7 abuts and is supported on a side of the counterpart 12 facing the plug 2 and the socket 3, hence in this particular embodiment on the outside of the motor housing. Thus the socket casing 7 is larger in the area of the support flange 14 than a diameter of a through hole 26 (see FIG. 3) provided in the counterpart 12 for passage of an additional section of the socket casing 7, including the plug-in contacts 5. The support flange 14 is designed and adapted to be grasped by the attachment flange 10 of the protective housing 9, which results in a positive connection of these parts. The attachment flange 10 therefore accommodates the support flange 14 and their contours are adapted to one another accordingly, such that an inner contour of the attachment flange 10 positively engages the outer contour of the support flange 14 in a face area of the plug casing 3.

The protective housing 9 is connected to a sum shield 16 in the form of a textile tube of a material containing metal and to a sum shield flange at an end of the protective housing 9 that faces away from the plug casing 3 and/or the attachment flange 10. In this way the plug connector 1 and/or a resulting plug connection is continuously shielded.

Figure 2:
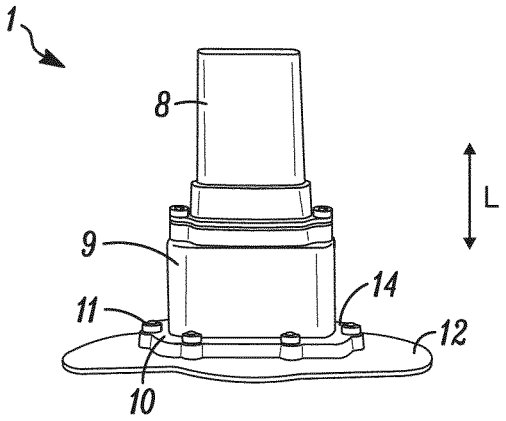
FIG. 2 shows the plug connector from FIG. 1 in the assembled state.

FIG. 2 shows the plug connector 1 of FIG. 1 now in the assembled state, with the electric wires 8 and the plug-in contacts 4 being hidden. The plug casing 3 and the socket casing 7 are held in a friction fit on the protective housing 9 attached to the counterpart 12. For this purpose the protective housing 9 at least partly grasps these two parts and presses them against the counterpart 12. Here the support flange 14 or the face 13 supports the socket casing 7 and the plug casing 3 plugged together with it on the counterpart 12, The protective housing 9 therefore fixes the entire plug connector 1 to the counterpart 12 through its attachment flange 10, In addition, the socket casing 7 is fixed to the counterpart 12 through the above-described clip connection and is positively held by the attachment flange 10 in such a way that the socket casing 7 and the plug casing 3 connected to it are also fixed in a peripheral direction of the plug connector 1.

Figure 3:
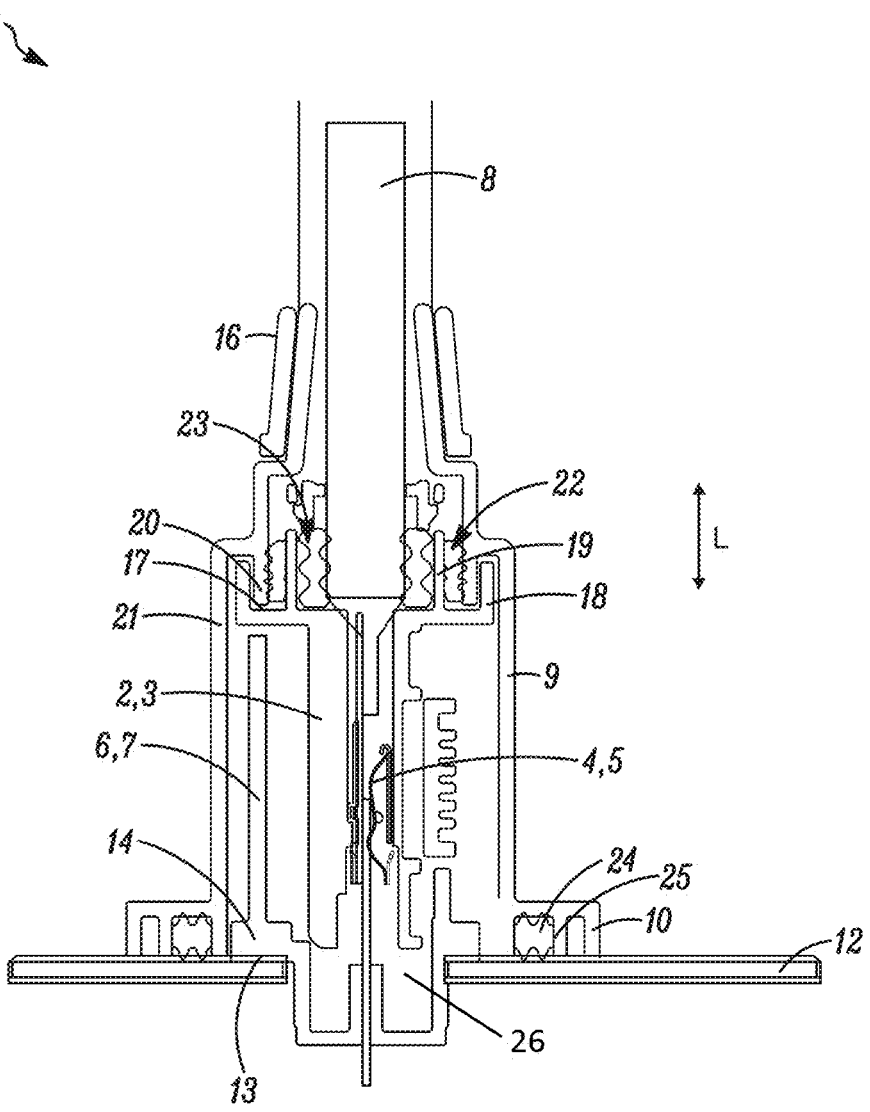
FIG. 3 is a sectional view of the plug connector from FIG. 1.

FIG. 3 shows a sectional view of the plug connector 1. FIG. 3 shows how the plug casing 3 and indirectly the socket casing 7 fixed to it are held on the counterpart 12 by the protective casing 9. For example, the plug casing 3 has an engagement channel 17 embodied here as a peripheral groove. The engagement channel 17 has an outer wall 18 and an inner wall 19. The outer wall 18 is formed by an integral first plug casing land and the inner wall 19 is formed by a second plug casing land. The two lands together form an engagement channel that is essentially U-shaped in the longitudinal direction L.

An engagement ridge 20 of the protective housing 9 engages in a positive and possibly also in a friction fit into the engagement channel 17 and extends in the form of a land in the longitudinal direction L of the plug connector 1. Thus, the engagement ridge 20 presses into the bottom of the engagement channel 17. This causes the plug casing 3 to be pushed along in the longitudinal direction L toward the counterpart 12, on which the plug casing 3 is supported in turn. An essentially U-shaped protective housing groove is formed between the engagement ridge 20 and an inner protective casing wall 21. The outer wall 18 of the engagement channel 17 engages in this groove. Thus, the plug casing 3 and the protective housing 9 mutually engage.

Depending on the particular design of the plug casing 3, a gap may be formed between the outer wall 18 and the inner protective housing wall 19. This gap is bridged by a plurality of peripheral ribs (not shown in FIG. 3) of the plug casing 3 that project from the outer wall 18 of the engagement channel 17 toward the protective housing 9. The plug casing 3 is supported on the protective housing wall 21 by these ribs.

A first sealing element 22 in the form of a sealing ring made of rubber is arranged in the engagement channel 17 to form a seal between the plug casing 3 and the protective housing 9. The first sealing element 22 thus abuts the inner wall 19 on the one hand and a side of the engagement ridge 20 facing the inner wall 19 on the other.

A second sealing element 23 is arranged on the side of the inner wall 19 opposite the first sealing element 22, in order to seal an area between the plug casing 3 and the electric wires 8. In the case of a plurality of electric wires 8, a correspondingly higher number of second sealing elements 23 is provided. The second sealing element 23 thus abuts the side of the inner wall 19 facing away from the engagement channel 17 on the one hand and the electric wires 8 to be sealed off on the other.

A third sealing element 24 is arranged in a peripheral sealing groove 25 of the attachment flange 10 of the protective housing 9 to form a seal between the protective housing 9 and the plug casing 3 and/or the socket casing 7.

Variations of the present disclosure are contemplated herein. For example, the plug connector 1 may be other than a three-pole connector, but rather a one-pole, two-pole, or other multi-pole connector. The protective housing 9 may be made of materials other than aluminum, such as any other material that is suitable for this purpose.

Having described aspects of the present disclosure in detail, it will be apparent that modifications and variations are possible without departing from the scope of aspects of the present disclosure as defined in the appended claims. As various changes could be made in the above constructions, products, and methods without departing from the scope of aspects of the present disclosure, it is intended that all matter contained in the above description and shown in the accompanying drawings shall be interpreted as illustrative and not in a limiting sense.

LIST OF REFERENCE NUMBERS

1 electrical plug connector
2 plug
3 plug casing

4 electrical contact part
5 plug-in contact
6 socket
7 socket casing
8 electric wire
9 protective housing
10 attachment flange
11 attachment element(s)
12 counterpart
13 face/supporting surface
14 support flange
15 peripheral through hole(s)
16 sum shield
17 engagement channel
18 outer wall
19 inner wall
20 engagement ridge
21 protective housing wall
22 first sealing element
23 second sealing element
24 third sealing element
25 sealing groove
26 through hole (e.g., through bore)
L longitudinal direction/plugging direction

The invention claimed is:

1. An electrical plug connector for a vehicle, comprising:
a plug comprising a plug casing, the plug casing comprising a contact chamber and an engagement channel;
a socket configured for receiving the plug in a plugging direction, the socket comprising a socket casing; and
a protective housing, at least partly encasing the plug casing and the socket casing, configured to shield the plug connector from electromagnetic interference, the protective housing comprising:
an attachment flange in a connecting area for connecting to a counterpart element; and
an engagement ridge configured to engage the engagement channel of the plug casing, the engagement ridge being spaced apart from the attachment flange in the plugging direction.

2. The plug connector according to claim 1, wherein:
the socket casing comprises a support flange on a face end of the socket casing, the support flange being configured to abut the counterpart element; and
the attachment flange couples to the support flange.

3. The plug connector according to claim 2, wherein an inner contour of the attachment flange positively engages an outer contour of the support flange in a face area of the plug casing.

4. The plug connector according to claim 1, wherein the plug and the socket are configured to press against the counterpart element when the protective housing is connected to the counterpart element.

5. The plug connector according to claim 1, wherein the engagement ridge extends in the plugging direction.

6. The plug connector according to claim 1, wherein at least one of the engagement ridge or the engagement channel is arranged peripherally in the plug connector.

7. The plug connector according to claim 1, wherein:
the protective housing comprises a groove formed by the engagement ridge and a wall of the protective housing; and
the engagement channel comprises an outer wall configured to engage with the groove.

8. The plug connector according to claim 1, comprising:
a first sealing element arranged between an inner wall of the engagement channel and the engagement ridge.

9. The plug connector according to claim 8, comprising:
a second sealing element arranged between the inner wall of the engagement channel and an electric wire connectable to the plug connector.

10. The plug connector according to claim 9, wherein the first sealing element and the second sealing element are separated by the inner wall of the engagement channel.

11. The plug connector according to claim 1, wherein:
the attachment flange comprises a sealing groove; and
the plug connector comprises a third sealing element arranged in the sealing groove.

12. The plug connector according to claim 1, wherein the plug connector is a high-voltage plug connector.

13. A high-voltage electrical plug connector for a vehicle, comprising:
a plug comprising a plug casing, the plug casing comprising an engagement channel;
a socket configured for coupling to the plug, the socket comprising a socket casing; and
a protective housing at least partly encasing the plug casing and the socket casing, the protective housing configured to shield the plug connector from electromagnetic interference, the protective housing comprising:
an upper end;
a lower end;
an attachment flange at the lower end for connecting to a counterpart element; and
an engagement ridge at the upper end configured to engage the engagement channel of the plug casing.

14. The plug connector according to claim 13, wherein:
the socket casing comprises a support flange on a face end of the socket casing, the support flange being configured to abut the counterpart element; and
the attachment flange couples to the support flange.

15. The plug connector according to claim 13, wherein the engagement ridge extends in a longitudinal direction.

16. The plug connector according to claim 13, wherein at least one of the engagement ridge or the engagement channel is arranged peripherally in the plug connector.

17. The plug connector according to claim 13, wherein:
the protective housing comprises a groove formed by the engagement ridge and a wall of the protective housing; and
the engagement channel comprises an outer wall configured to engage with the groove.

18. The plug connector according to claim 13, comprising:
a first sealing element arranged between an inner wall of the engagement channel and the engagement ridge.

19. The plug connector according to claim 18, comprising:
a second sealing element arranged between the inner wall of the engagement channel and an electric wire connectable to the plug connector.

20. The plug connector according to claim 19, wherein the first sealing element and the second sealing element are separated by the inner wall of the engagement channel.

* * * * *